United States Patent [19]

Good

[11] 4,048,768

[45] Sept. 20, 1977

[54] DEVICE FOR LOCKABLY SECURING APPURTENANCES TO A DECORATIVE WALL

[75] Inventor: Wayne W. Good, Sturgis, Mich.

[73] Assignee: Harter Corporation, Sturgis, Mich.

[21] Appl. No.: 728,432

[22] Filed: Sept. 30, 1976

[51] Int. Cl.[2] ..... E04B 1/00; A47B 5/60

[52] U.S. Cl. ..... 52/36; 52/278; 52/286; 52/586; 248/243

[58] Field of Search ..... 52/36, 278, 281, 286, 52/586, 122, 275, 284, 475, 582; 248/24, 3, 222, 211

[56] References Cited

U.S. PATENT DOCUMENTS

| | | | |
|---|---|---|---|
| 2,245,705 | 6/1941 | Norris | 52/36 |
| 2,691,502 | 10/1954 | Jones | 52/36 |
| 2,998,107 | 8/1961 | Zimmerla | 52/36 |
| 3,713,257 | 1/1973 | Beavers | 52/36 |
| 3,871,144 | 3/1975 | Rudin | 52/36 |
| 3,886,698 | 6/1975 | Raith et al. | 52/36 |

*Primary Examiner*—Price C. Faw, Jr.
*Assistant Examiner*—Robert C. Farber
*Attorney, Agent, or Firm*—Hamilton, Renner & Kenner

[57] ABSTRACT

An appurtenance may be lockably secured to a decoratable wall by the disclosed device. The decoratable wall includes a decoratable panel with a resilient edge, at least one spline with a plurality of slots therein, and a frame supporting the panel and spline. The device includes a bracket to which the appurtenance may be attached having at least one hook member for removable insertion into a first slot in the spline, and a safety lock carried by and movable with respect thereto into engagement with a second slot of the same spline. The safety lock ensures the hook member may not be disengaged from the spline while the safety lock is engaged with the second slot.

5 Claims, 2 Drawing Figures

DEVICE FOR LOCKABLY SECURING APPURTENANCES TO A DECORATIVE WALL

BACKGROUND OF THE INVENTION

The present invention relates generally to a device for lockably securing an appurtenance to a decoratable wall.

There exists a great number of decoratable wall or space dividers useful for partitioning office complexes, commercial or residential rooms and the like. Often it is desirable to provide devices by which one may attach appurtenances such as shelves to such decoratable walls. In order to eliminate damage and injuries which may result from the accidental disengagement of such appurtenances from the wall, many safety regulations such as those promulgated by the Occupational Safety and Health Administration require that such attachment devices be capable of lockably securing the appurtenance to the wall. As a result of the structure of such walls, these devices have been relatively costly and complex, requiring the integration of a plurality of separate pieces in construction, installation, and operation.

I have invented novel decoratable walls, disclosed in my co-pending applications filed contemporaneously herewith, Ser. Nos. 728,383 and 728,433 which incorporate certain novel features noted in the description of the present invention that make possible the present invention and with which the present invention may be utilized. One such feature is that of a resilient edge of a decoratable panel within the wall which maintains the locking means removably engaged with a slot in a spline within the wall.

SUMMARY OF THE INVENTION

It is, therefore, a primary object of the present invention to provide a device for lockably securing an appurtenance to a decoratable wall.

It is another object of the present invention to provide a device, as above, which requires the installation of only a single piece, thereby greatly simplifying installation, operation and removal of the device.

It is still another object of the present invention to provide a device, as above, in which the locking means is removably maintained in a locked condition by the resilient edge of a decoratable panel within the wall.

These and other objects, together with the advantages thereof over existing and prior art forms which will become apparent from the following specification and drawings, are accomplished by the means hereinafter described.

In general, a device embodying the concept of the present invention may be utilized with a decoratable wall having a decoratable panel with a resilient edge, at least one spline with a plurality of slots therein, and a frame supporting the panel and spline. Generally, the device includes a bracket to which an appurtenance may be attached having at least one hook member for removable insertion into a first slot in the spline, and locking means carried by the bracket and movable with respect thereto into engagement with a second slot of the same spline. The locking means ensures the hook member may not be disengaged from the spline while the safety lock is engaged with the second slot.

DESCRIPTION OF THE PREFERRED EMBODIMENT

Figure 1:
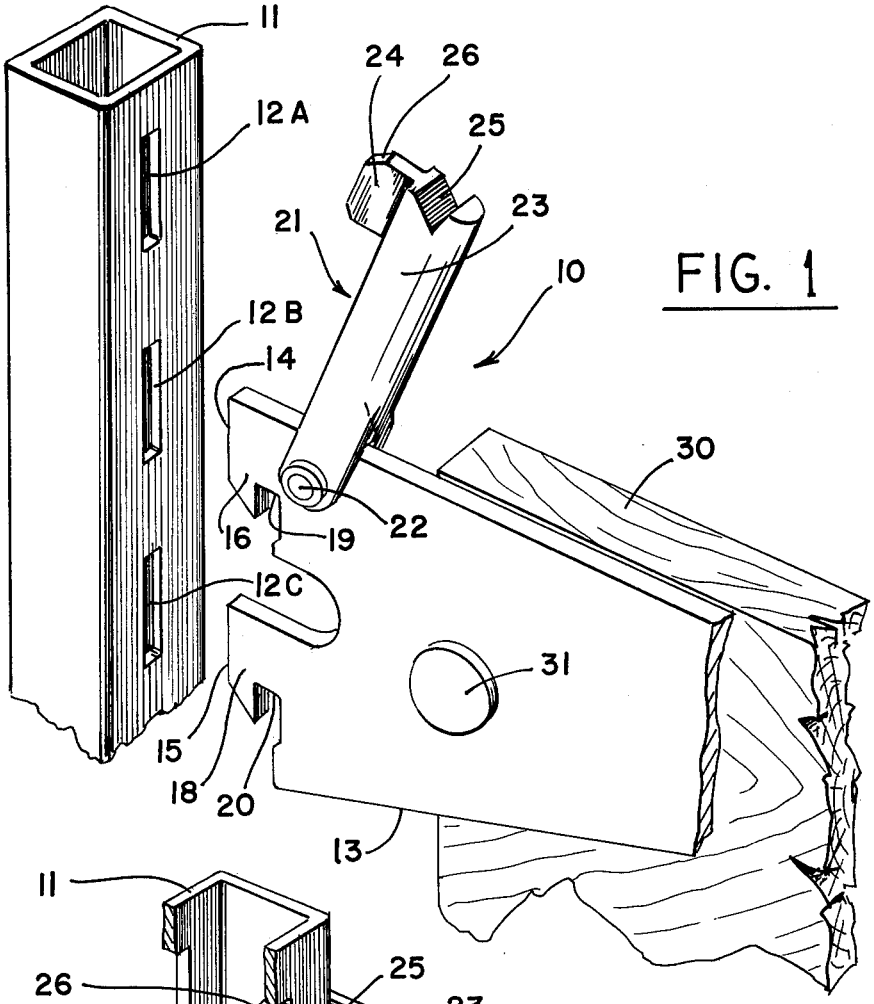
FIG. 1 is a perspective view of a device for lockably securing an appurtenance to a decoratable wall embodying the concept of the present invention and depicting particularly the device disengaged from a spline within the wall.

Referring now to FIG. 1, a device for lockably securing an appurtenance to a decoratable wall embodying the concept of the present invention is illustrated generally by the numeral 10. Also illustrated is a spline 11 having in two opposite sides slots 12 into which device 10 is engaged as described hereinafter. In a manner not relevant herein, the spline 11 may be supported by the same frame (not shown) which supports the entire decoratable wall assembly (also not shown). For convenience device 10 and spline 11 are depicted and shall hereinafter be referred to in the description with the longitudinal axis of spline 11 and the axis of device 10 parallel thereto as the "vertical axis". It should be appreciated that device 10 may be mounted and will operate equally well in any attitudinal position.

Device 10 includes a tapered bracket 13 having upper and lower hook members 14 and 15 respectively, which may be integrally connected with bracket 13 extending from the wide end thereof. Hook members 14 and 15 are insertable into the slots of the spline 11 and, to maintain engagement therewith, include arms 16 and 18 having notches 19 and 20 respectively, cut therein. Of course, the center spacing between hook members 14 and 15 should equal an integer multiple of that between adjacent slots 12 on spline 11. Where back-to-back mounting of two appurtenances at the same height on spline 11 is desired, arms 16 and 18 should be designed so as to extend no more than half way into the spline 11. This insures two brackets may be inserted back-to-back into slots 12 at the same height but on opposite sides of spline 11. It is to be noted that bracket 13 must have at least one hook member but may have as many as desired or believed necessary to support the desired appurtenance in the manner detailed below.

A safety lock, indicated generally by the numeral 21, straddles the top edge of bracket 13 and is pivotally connected thereto via suitable means such as rivet 22. Rivet 22 must be located at such a horizontal distance away from arm 14 so as to ensure that when device 10 is engaged with spline 11 safety lock 21 is in a vertical position abutting spline 11, as illustrated in FIG. 2.

Safety lock 21 is generally L-shaped and includes vertical member 23, base arm 24, and a notch 25. Base arm 24 may be integrally connected at the top of vertical member 23 for engagement with the next adjacent slot 12A above that in which hook member 14 is engaged, the height of vertical member 23 being adjusted accordingly. It should be noted that, where desired, the height of vertical member 23 may be designed such that base arm 24 is inserted into a slot 12 other than the next adjacent one. The vertical height of base arm 24 itself must be less than the vertical height of slot 12A and the leading shoulder 26 of base arm 24 may be rounded, both in order to permit pivotal insertion of base arm 24 into slot 12A. Notch 25 may be provided and the side of vertical member 23 opposite that to which base arm 24 is connected may be rounded, both in order to facilitate disengagement of safety lock 2; from slot 12A as hereinafter described.

Figure 2:
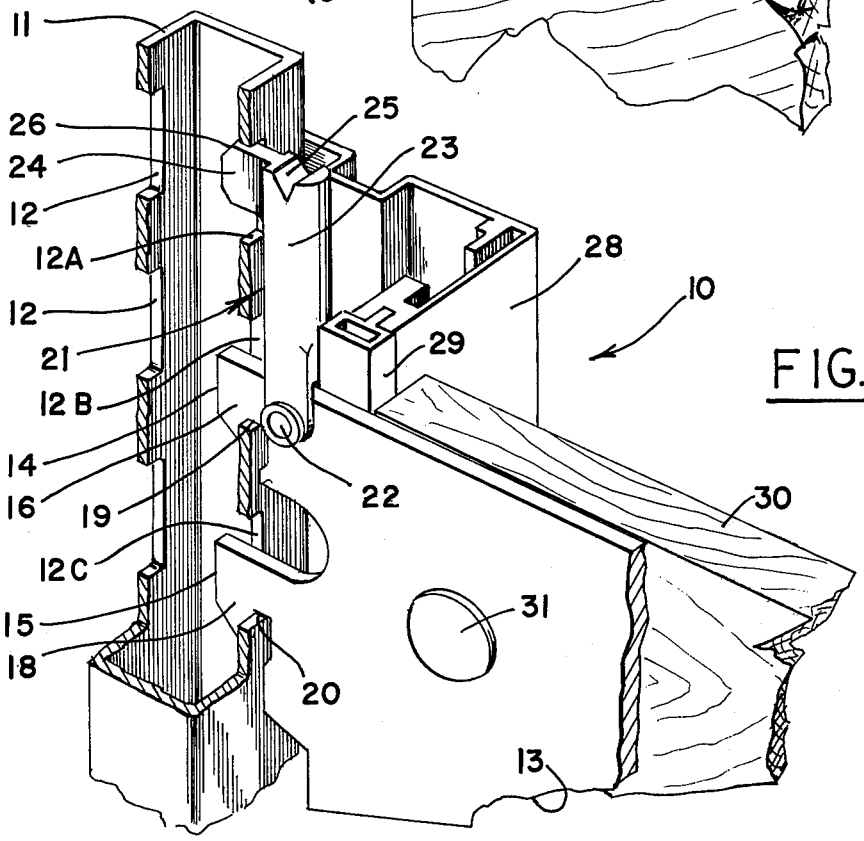
FIG. 2 is a perspective view similar to FIG. 1 but illustrating the device engaged with the spline.

As described in my previously noted co-pending applications, a decoratable wall with which device 10 may be utilized should include a panel frame 28 and must include some resilient biasing means such as extrusion 29 which may, in addition to its function(s) within the decoratable wall, removably maintain safety lock 21 engaged in slot 12A as depicted in FIG. 2.

The appurtenance, such as vertical shelf member 30 may fasten to bracket 13 by any means that would occur to one skilled in the art such as by screw 31 or adhesion. Of course, vertical shelf member 30 must be attached to bracket 13 at such a horizontal distance away from the wide end of bracket 13 to at least equal the distance by which frame 28 extends horizontally out from the spline 11 in order to permit proper engagement of hook members 14, 15 in slots 12B, 12C, respectively.

Operationally, only two steps are involved for lockably securing bracket 13 to spline 11. First, with safety lock 21 pivoted away from spline 11 as shown in FIG. 1, hook members 14 and 15 are inserted into whichever slots 12 are desired until vertical shelf member 30 abuts extrusion 29 and/or frame 28, whereupon a downward force is applied thereby engaging notches 19 and 20 respectively, with slots 12B and 12C, respectively, as illustrated in FIG. 2. Next, safety lock 21 may be forceably inserted into the next adjacent slot 12A above that in which hook member 14 is engaged, extrusion 28 giving way to permit such insertion. After insertion of safety lock 16 into slot 12A, extrusion 29 removably maintains safety lock 21 in engagement with slot 12A.

It should be evident that when device 10 is in this "locked condition" any upward force on device 10 or the appurtenance fastened thereto will fail to disengage device 10 from spline 11 as a result of an equal and opposite downward force applied by slot 12A on base arm 24. Of course, hook members 14 and 15 prevent any horizontal force from causing disengagement of device 10 from spline 11.

Disengagement of device 10 may be accomplished in a similar manner, but in reverse order to that of its engagement. Where desirable, a screwdriver or a similar such tool may first be inserted into notch 25 and utilized to facilitate pivotal withdrawal of safety lock 21 from slot 12A. Next, hook members 14 and 15 may be disengaged and withdrawn from slots 12B and 12C, respectively, thus completing separation of the vertical shelf member 30 from the decoratable wall.

It is to be noted that extrusion 29 need only be sufficiently resilient as to permit safety lock 21 to be inserted and removed as previously described. Specifically with respect to the decoratable wall art, it is to be further noted that the device 10 will operate equally well where separate panels are adjacent to both sides of spline 11, i.e., where there are extrusions 29 on both sides of bracket 13.

Inasmuch as the present invention is subject to many variations, modifications and changes in detail, a number of which have been expressly stated herein, it is intended that all matter described throughout this entire specification or shown in the accompanying drawings be interpreted as illustrative and not in a limiting sense. It should thus be evident that a device constructed according to the concept of the present invention, and reasonably equivalent thereto, will accomplish the objects of the present invention and otherwise substantially improve the art of lockably securing an appurtenance to a decoratable wall.

What is claimed is:

1. A device for lockably securing an appurtenance to a decoratable wall, the wall having at least one decoratable panel, and at least one spline with a plurality of slots therein, and a frame supporting the panel and splines, comprising:

bracket means to which the appurtenance may be attached having at least one hook member for removable insertion into a first slot in a spline, and locking means mounted on said bracket means and movable with respect thereto into engagement with a second slot of the same spline, for preventing disengagement of said hook member from said spline while said locking means is engaged with said second slot.

2. A device, as in claim 1, wherein said locking means is pivotably attached to said bracket means for removable engagement with said second slot.

3. A device, as in claim 2, wherein said second slot is adjacent to said first slot.

4. A device, as in claim 3, wherein said locking means includes notch means for facilitating forceable disengagement of said locking means with said second slot.

5. A device, as in claim 1, wherein said panel has a resilient edge, said resilient edge removably maintaining said locking means engaged in said second slot.

* * * * *